US005182985A

United States Patent [19]

Gutowski

[11] Patent Number: 5,182,985

[45] Date of Patent: Feb. 2, 1993

[54] PNEUMATIC PRESS WITH REVERSED PISTON AND CYLINDER

[75] Inventor: Timothy A. Gutowski, Spring Lake, Mich.

[73] Assignee: Contour Roll Company, Grand Haven, Mich.

[21] Appl. No.: 672,955

[22] Filed: Mar. 21, 1991

[51] Int. Cl.[5] ..... B30B 1/38

[52] U.S. Cl. ..... 100/35; 72/453.01; 83/639.1; 92/117 A; 100/266; 100/269 R

[58] Field of Search ..... 100/257, 266, 269 R, 100/35; 72/445, 453.01; 83/639.1, 530, 588; 92/117 A

[56] References Cited

U.S. PATENT DOCUMENTS

| | | | |
|---|---|---|---|
| 1,861,337 | 5/1932 | Ernst | 72/453.13 X |
| 2,786,409 | 3/1957 | Claire | 100/269 R |
| 3,450,037 | 6/1969 | Lickliter et al. | 100/49 X |
| 3,472,109 | 10/1969 | Haas et al. | 100/266 X |
| 3,478,678 | 11/1969 | Lickliter et al. | 100/49 |
| 3,545,368 | 12/1970 | Lickliter et al. | 100/49 |
| 3,568,559 | 3/1971 | Fink | 100/269 R X |
| 3,599,561 | 8/1971 | Reeves | 100/266 X |
| 4,079,617 | 3/1978 | Whiting | 100/269 B X |
| 4,341,105 | 7/1982 | Gerrick, Jr. | 100/269 R X |
| 4,470,346 | 9/1984 | Nelson | 100/269 R X |
| 4,506,578 | 3/1985 | Gaines et al. | 100/269 A X |
| 4,633,742 | 1/1987 | Gutowski et al. | 100/48 X |
| 5,062,357 | 11/1991 | Senior et al. | 100/269 R X |

*Primary Examiner*—Harvey C. Hornsby
*Assistant Examiner*—Stephen F. Gerrity
*Attorney, Agent, or Firm*—Price, Heneveld, Cooper, Dewitt & Litton

[57] ABSTRACT

A high speed pneumatic press is provided with an arrangement which reduces moving mass thereby reducing the tendency of the press to vibrate and "walk" during operation and also minimizing wear on the press. The press includes a fluid actuated ram having a ram cylinder and ram piston, the ram cylinder being lower in mass than the ram piston and connected to a reciprocating platen thereby reducing the moving mass associated with the reciprocating platen.

8 Claims, 2 Drawing Sheets

PNEUMATIC PRESS WITH REVERSED PISTON AND CYLINDER

BACKGROUND OF THE PRESENT INVENTION

The present invention relates to pneumatic presses and the like, and in particular to a press arrangement which greatly reduces vibration, and those problems associated therewith.

Pneumatic presses are generally well known in the art, and comprise mating platens which reciprocate through a stroke defined between open and closed platen positions. An air actuated cylinder or ram is positioned generally between the platens, and moves the reciprocating one of the platens toward and away from the stationary one of the platens.

Recently, the speed of the reciprocating platen has been increased to enhance press productivity. However, along with the speed increase has come an increased tendency of the press to vibrate, and those problems associated with such vibration, including noise, part wear, and the like. "Walking" is another problem associated with excess press vibration, and is generally defined as the tendency of the press to move laterally off of its foundation or supporting surface over a number of cycles. "Walking" is particularly prevalent in high speed presses. Present efforts to reduce "walking" have focused on controlling or reducing the shock of the downstroke of the reciprocating platen, but have proven less than completely effective.

A further drawback associated with high speed presses is that the higher speeds tend to make press control more difficult, tend to make bearings and the like wear out more quickly, and generally increase press cost and maintenance.

Hence, it is desirable to provide a pneumatic press with a reduced tendency to vibrate and walk, so that press costs and maintenance requirements are minimized.

SUMMARY OF THE INVENTION

Surprisingly, it has been discovered that the major vibration and "walking" problem in high speed pneumatic presses is primarily caused by the upstroke of the reciprocating platen, as opposed to the downstroke. Thus, the present invention comprises a fluid actuated ram operably connected to a reciprocating platen and designed to minimize moving mass and inertia during the stroke of the reciprocating platen thereby reducing the tendency to vibrate and "walk". In the preferred embodiment, the invention is comprised of reversing the orientation of the piston and cylinder so as to minimize moving mass. This not only reduces moving mass, but also allows use of existing parts without major redesign.

One aspect of the present invention then is to provide a pneumatic press with a reduced tendency to vibrate and to walk.

Another aspect of this invention allows considerable mass to be removed from the reciprocating platen thus reducing the return springs required and resulting in reduced air consumption and greater ram speed and control.

Another aspect of this invention allows considerable mass to be removed from the reciprocating platen without major modification of parts.

Another aspect of this invention allows reduced press maintenance due to the reduced moving mass.

Another aspect of this invention allows increased press life due to the reduced moving mass.

Another aspect of this invention allows for reduced press cost due to lesser foundation and part requirements which are in turn due to the reduced tendency to vibrate and walk.

These and other features, advantages and objects of the present invention will be further understood and appreciated by those skilled in the art by reference to the following specification claims and appended drawings.

DETAILED DESCRIPTION OF THE PREFERRED EMBODIMENTS

Figure 1:
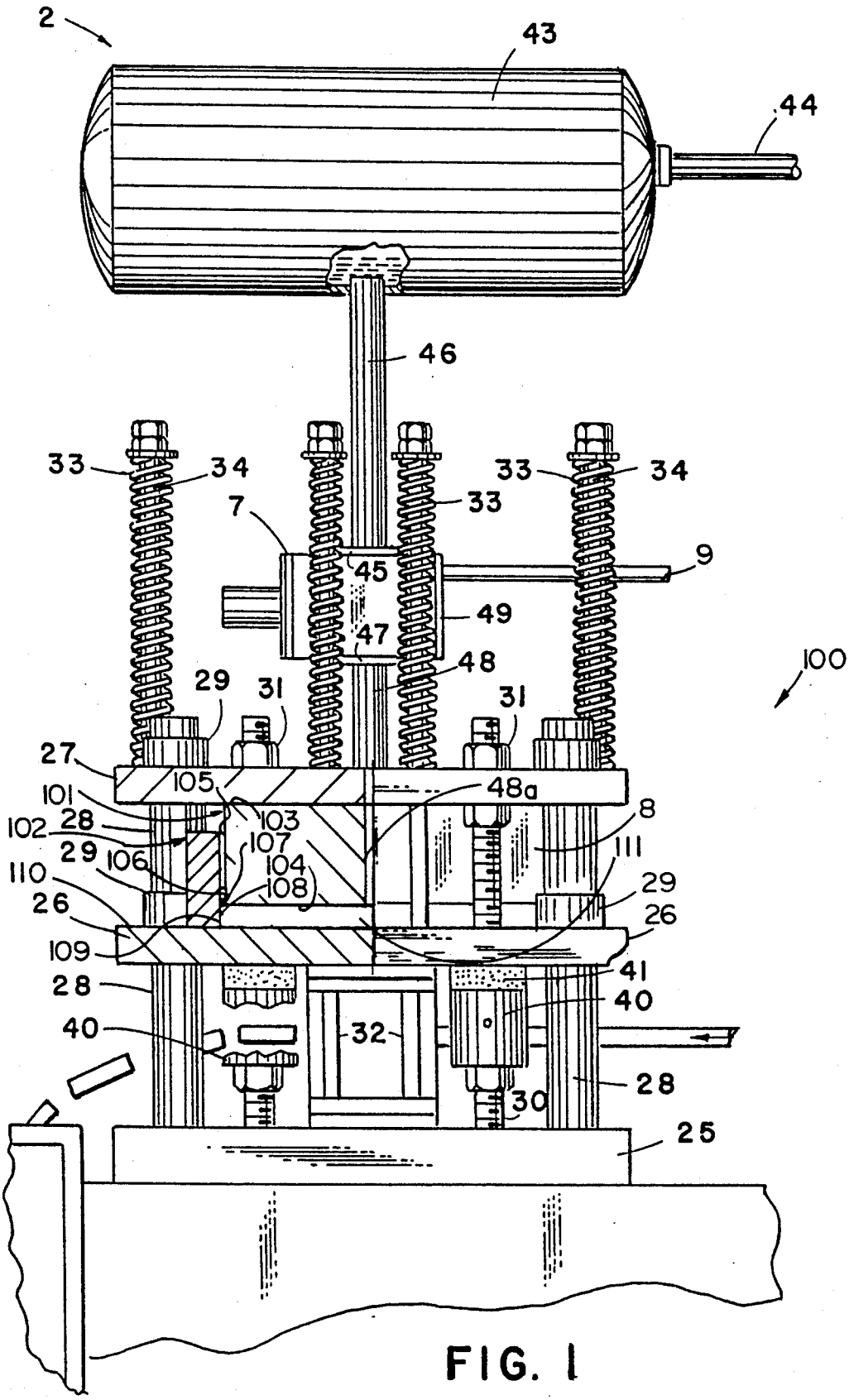
FIG. 1 is a side elevational view of a pneumatic press embodying the present invention with a cross-section taken half way into one side, the press shown with the reciprocating platen in a substantially closed position.

Reference numeral 100 (FIG. 1) generally designates a pneumatic press embodying the present invention, press 100 being particularly adapted for minimizing the moving mass associated with a reciprocating platen 26 to minimize the tendency of the press to vibrate and walk. The illustrated pneumatic press 100 described in U.S. Pat. No. 4,633,742 issued to Gutowski et al. on Jan. 6, 1987 and is entitled: PNEUMATIC PRESS CONTROLLER AND METHOD, the disclosure of which is incorporated herein by reference except as specifically modified. Though the preferred embodiment disclosed utilizes compressed air, it is to be understood that the term "pneumatic press" as used herein is intended to include presses that are actuated not only by high pressure air, but also presses that are actuated by other high pressure gases and fluids.

The illustrated pneumatic press 100 has a generally conventional construction, and comprises a stationary platen 25, a reciprocating platen 26, and an adjustable platen 27. Vertical support rods 28 are connected with and upstanding from stationary platen 25 adjacent the four corners thereof. Reciprocating platen 26 and adjustable platen 27 are slideably mounted on support rods 28 by bearings 29. Adjustable support rods 30 are also connected with stationary platen 25, and extend vertically upwardly therefrom. Adjustable support rods 30 extend through mating apertures in reciprocating platen 26, and the upper ends of adjustable support tie rods 30 are attached to adjustable platen 27 by nuts 31. Adjustable support tie rods 30 mount adjustable platen 27 on stationary platen 25, and permit adjusting the vertical height therebetween to accommodate different dies 32. Air actuated pneumatic ram 8 is positioned between adjustable platen 27 and reciprocating platen 26, such that the extension of ram 8 moves reciprocating platen 26 downwardly to converge the die halves into a closed position, and retraction of ram 8 permits platen 26 to move upwardly to diverge the die halves into an open position. In the illustrated example, return springs 33 are mounted on adjustable platen 27 by mating rods 34, and resiliently urge reciprocating platen 26 upwardly in a return stroke, and automatically return the die halves to the open position when the downward power stroke of press 100 is halted.

A plurality of stops 40 are mounted on adjustable support rods 30 at the lower portion of press 100, and include bumpers 41, which are adapted to engage the lower surface of reciprocating platen 26 to positively stop downward translation of the same, and thereby fix the bottom position of the press power stroke. Stops 40 are vertically adjustable on support tie rods 30 so as to vary the bottom stroke position in accordance with the specific type of press operation and application desired.

In the illustrated example, press 100 includes a high pressure air reservoir 43, which communicates with a source of pressurized air through pipe 46. The inlet side 45 of valve 7 communicates with air reservoir 43 through a pipe 46, and the outlet side 47 of valve 7 communicates with ram 8 through a pipe 48. Valve control line 9 extends laterally from valve 7 to a press control panel and controller (not shown).

The present invention is primarily focused in the arrangement of air actuated ram 8 with respect to platens 25, 26, and 27. Air actuated ram 8 is comprised of a piston 101 and a cylinder 102. Historically, piston 101 is heavier than cylinder 102 due to design requirements, and is fastened to reciprocating platen 26 to maximize the moving mass (i.e. inertia) of reciprocating platen 26. The theory was that by increasing the momentum of reciprocating platen 26, a more reliable and repeatable downward stroke could be achieved. Theoretically, this lead to more reliably formed and consistent parts. However, this large moving mass resulted in a "vibration" problem in high speed presses causing noise, part wear and the like. The vibration also often causes the press to "walk" wherein the press would literally "walk" stepwise off of its foundation with time and use. The walking problem was considered by many experts in the industry to be due to the vibrations and other forces caused during the downstroke when the reciprocating ram struck the workpiece. However, in the present invention, it has been found that the walking is caused in large part by the upstroke and braking on the upstroke of reciprocating platen 26. By reducing moving mass, the vibration, and in turn this walking problem, is greatly reduced.

Further, presses with large moving masses associated with the reciprocating platen have increased problems of vibration and wear out due to the large moving mass. To compensate, foundation requirements are increased and parts are made larger and stronger leading to press cost increases. Air consumption required to move the large mass reciprocating platen is increased and press control is more difficult.

In the preferred embodiment, the orientation of piston 101 and cylinder 102 are reversed so that piston 101 is connected to adjustable platen 27 and cylinder 102 is connected to reciprocating platen 26. This novel arrangement is particularly advantageous since it does not require major redesign of parts. More specifically, piston 101 includes an upper mating surface 103 that matingly engages the bottom surface of adjustable platen 27. Piston 101 is secured to adjustable platen 27 by several bolts (not shown) which extend downwardly through adjustable platen 27 and threadingly into piston 101. Piston 101 further includes a lower surface 104 and side surface 105. A compression sealing element 106 is mounted on side surface 105 near to lower surface 104 and is retained by retaining elements 107 on side surface 105.

Cylinder 102 is ring-like in shape and matingly surrounds piston 101 in sliding relationship. The inside surface 108 of cylinder 102 is machined for sealing engagement with sealing element 106 of piston 101. Cylinder 102 also includes a lower mating surface 109 that matingly sealingly engages the upper surface 110 of reciprocating platen 26. Cylinder 102 is secured to reciprocating platen 26 by several bolts (not shown) which extend upwardly through reciprocating platen 26 and threadingly into cylinder 102.

Thus, a compression chamber 111 is formed as defined by piston lower surface 104, cylinder inside surface 108, and reciprocating platen upper surface 110. Compressed air is conveyed to and from compression chamber 111 by pipe 48 which extends downwardly from valve 7 centrally into piston 101 through port 48A. Further, compressed air is contained by sealing element 106 which allows piston 101 to slideably reciprocate vertically on cylinder 102 thereby permitting control of the movement of reciprocating platen 26 by controlling the introduction of compressed air into compression chamber 111.

Figure 2:
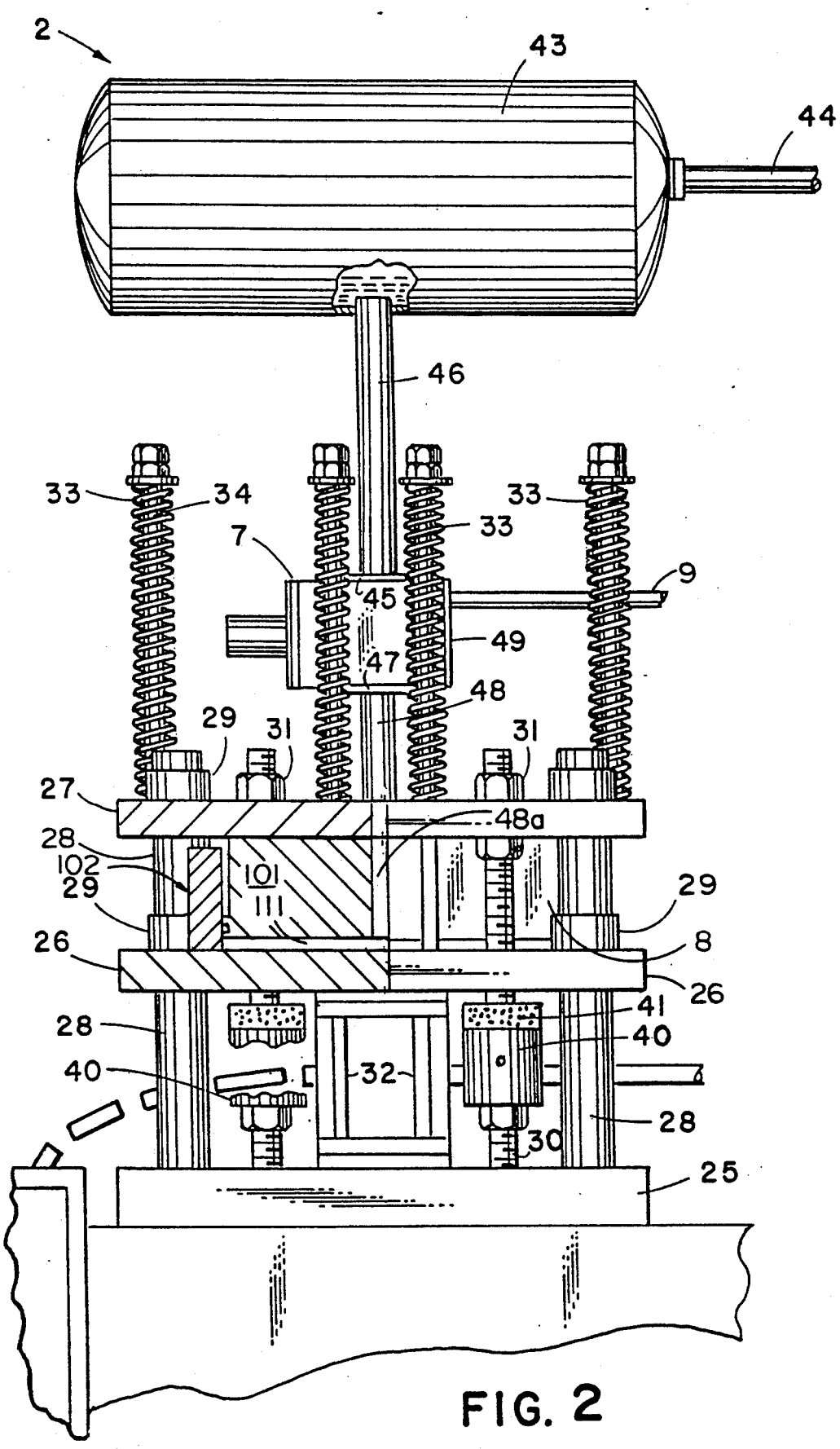
FIG. 2 is a side elevational view of a pneumatic press embodying the present invention with a cross-section taken half way into one side, the press shown with the reciprocating platen in a partially open position.

As compressed air is introduced into compression chamber 111 through pipe 48 reciprocating platen 26 and cylinder 102 are forced downwardly to the closed position (FIG. 1) wherein a workpiece is formed. As compressed air is vented through pipe 48, springs 33 return reciprocating platen 26 and cylinder 102 to their normally open position (FIG. 2). Due to the novel arrangement of piston 101 and cylinder 102 on platens 26, 27, moving mass is reduced thereby reducing the tendency of press 100 to vibrate and walk.

It is contemplated that there will be additional savings due to the reduced moving mass. Such savings include savings in original press costs such as reduced foundation requirements, reduced bearing requirements, lighter or less platen return springs, and potential savings in other high stress/high wear parts. Further, savings are anticipated in routine and non-routine maintenance due to the reduced vibration and moving mass. Also, operator comfort is enhanced due to the reduced vibration and noise. The reduced moving mass has also resulted in reduced air consumption, greater ram speed, and greater ram control at the bottom of the stroke.

In the foregoing description it will be readily appreciated by those skilled in the art that modifications may be made to the invention without departing from the concepts disclosed herein. Such modifications are to be considered as included in the following claims, unless these claims by their language expressly state otherwise.

I claim:

1. A high speed pneumatic press having a reduced level of vibration during operation thereof, comprising:

a fixed platen adapted to be supported by a floor surface;

a reciprocating platen movable with respect to said fixed platen between a power stroke and a return stroke, and adapted for operable connection with a die to actuate the same;

a pneumatically actuated ram adapted for selectively moving said reciprocating platen toward said fixed platen during the power stroke, and including a cylinder and a mating piston which are telescopingly interconnected for mutual reciprocation; said cylinder and said piston each having a predetermined mass selected such that the mass of said cylinder is less than the mass of said piston;

means for selectively moving said reciprocating platen away from said fixed platen during the return stroke;

means for connecting said piston with said fixed platen, such that said piston is generally stationary during press operation; and means for connecting said cylinder with said reciprocating platen, such that said cylinder reciprocates therewith during press operation, said cylinder and said reciprocating platen being securely interconnected to define a combined mass that minimizes the moving mass and resulting inertia generated during operation of said press, whereby the press produces a reduced level of press vibration during operation of the press.

2. The apparatus as defined in claim 1 wherein said means for connecting said piston with said fixed platen includes a second platen and also includes rod means for connecting said second platen to said fixed platen, and wherein said piston is attached to said second platen.

3. The apparatus as defined in claim 2 wherein said second platen and said fixed platen define a space that is adjustable by use of nut means located on said rod means.

4. The apparatus as defined in claim 1 wherein said pneumatic ram is actuated by compressed air.

5. A high speed pneumatic press having a reduced level of vibration during operation of the press comprising:

mating platens including a reciprocating platen which moves through a stroke defined between open and closed platen positions;

a high speed, fluid actuated ram including a piston and a cylinder operably connected to said reciprocating platen so as to minimize moving mass during the stroke, said cylinder and said reciprocating platen being securely interconnected to define a combined mass that minimizes the moving mass and resulting inertia generated during operation of said press;

means for actuating said fluid actuated ram to cause said reciprocating platen to move to the closed position; and means for automatically diverging said platens to the open position.

6. The apparatus as defined in claim 5 wherein said cylinder has a lesser mass than said piston, and said cylinder is attached to said reciprocating platen.

7. The apparatus as defined in claim 5 wherein said fluid actuated ram is actuated by compressed air.

8. A method for reducing the tendency of a pneumatic press to vibrate:

providing a press with mating platens including a fixed platen, a reciprocating platen, and a fluid actuated ram for selectively moving said reciprocating platen at high speed, said ram including a piston and a mating cylinder adapted to be operably connected to said fixed and reciprocating platens, respectively, the mass of said cylinder being less than the mass of said piston said cylinder and said reciprocating platen being securely interconnected to define a combined mass that minimizes the moving mass and resulting inertia generated during operation of said press;

operably connecting said piston to said fixed platen, such that said piston is generally stationary during press operation;

connecting said cylinder to said reciprocating platen such that said cylinder reciprocates therewith during press operation; and moving the reciprocating platen and the cylinder at high speed while holding the piston stationary, thereby reducing press vibration.

* * * * *